United States Patent [19]

Robinson

[11] 4,450,670

[45] May 29, 1984

[54] WEED CUTTER FOR BOAT MOTOR

[76] Inventor: Richard L. Robinson, 8198 Speach Dr., Baldwinsville, N.Y. 13027

[21] Appl. No.: 121,706

[22] Filed: Feb. 15, 1980

[51] Int. Cl.[3] ..... A01D 44/00

[52] U.S. Cl. ..... 56/8; 440/73

[58] Field of Search ..... 56/8, 9; 440/73

[56] References Cited

U.S. PATENT DOCUMENTS

| | | | |
|---|---|---|---|
| 726,180 | 4/1903 | Miller | 440/73 |
| 911,939 | 2/1909 | Casaday | 440/73 |
| 1,649,657 | 11/1927 | Blake | 440/73 |
| 2,470,874 | 5/1949 | Sidney | 56/8 |

*Primary Examiner*—Jay N. Eskovitz

*Attorney, Agent, or Firm*—Bruns & Wall

[57] ABSTRACT

A cutting tool for use in conjunction with the propeller assembly of a boat to prevent underwater foliage from fouling the drive mechanism of the boat. The shank end of the tool is secured to the motor housing and supports the cutting blade end thereof in close proximity with the propeller hub. As the hub rotates, underwater foliage encountered by the propeller assembly is swept into contact with the cutting edges of the blade whereupon the foliage is cut and the cutting thrown away from the motor.

4 Claims, 4 Drawing Figures

WEED CUTTER FOR BOAT MOTOR

BACKGROUND OF THE INVENTION

This invention relates to a cutting tool for use in conjunction with the propeller assembly of a boat motor which serves to prevent weeds and other kinds of underwater foliage from fouling the drive mechanism of the boat.

The amount of underwater vegetation found in lakes and streams has been increasing at an alarming rate over the past few years. Along with depleting the available oxygen supply from the water, this generally unwanted growth also tends to become entangled within the driving mechanism of propeller-driven boats. The underwater foliage typically wraps itself about the propeller assembly causing the motor to slow down or even stall. In some cases where the foliage is relatively dense, the drive mechanism of the boat can be taxed to a point where damage results. The problems associated with this type of foliage become even more pronounced in the case of small outboard motors as typically used by fishermen who troll or otherwise navigate in relatively shallow waterways.

One method of protecting a motor from fouling in dense vegetation or weeds is to place a guard or shield about the propeller assembly. Apparatus of this type is disclosed in U.S. Pat. No. 2,983,246. The guard, in order to properly protect the motor parts from underwater foliage, must be relatively heavy, complex and cumbersome. Accordingly, an added weight and drag is placed upon the motor that cuts down on its efficiency and performance. The adverse effect of a guard upon the performance of small size motors can be so pronounced that the motors are unable to carry out their intended functions even under normal operating conditions.

Cutting blades have also been devised for use in association with outboard motors which cut underwater vegetation before it has a chance to contact the motor parts. Once cut, the severed foliage is somehow pushed away from the immediate vicinity of the motor. As illustrated in U.S. Pat. No. 2,470,874, this type of weed cutter generally consists of a vertically positioned knife-like blade that is mounted reasonably well forward of the motor housing so it moves through the water with a minimum amount of resistance. Laterally spaced deflector blades are also provided to further cut the foliage and direct the cutting away from the propeller assembly. The exposed cutting edges of these blades, of course, present an added hazard to humans and wildlife inhabiting the waters.

Regardless of whether a blade or a guard is used to protect the motor, the theory of operation in both cases centers on not allowing foliage to come into contact with the motor part and, in particular, the propeller assembly. In either application, once cut or uncut foliage gets into the propeller, it will invariably wrap itself about the propeller hub and cause problems.

SUMMARY OF THE INVENTION

It is an object of this invention to improve apparatus for preventing weeds and the like from fouling the drive mechanism of a motor.

A further object of the present invention is to provide a simple weed cutting attachment for use in conjunction with a boat propeller assembly that prevents underwater foliage from fouling the drive mechanism.

Another object of the present invention is to reduce the weight and amount of drag produced by equipment used to protect a boat motor from the harmful effects of underwater foliage.

A still further object of the present invention is to provide a weed cutting tool that can be effectively utilized in association with a relatively small boat motor.

Yet another object of the present invention is to provide a blade attachment that can be easily secured to a wide variety of boat motors for preventing underwater foliage from damaging the motor.

A still further object of the present invention is to provide a relatively safe weed cutting tool for use in conjunction with a boat motor.

These and other objects of the present invention are attained by means of a simple cutting tool that has a shank which can be easily secured to the housing of a boat motor and a blade having a cutting edge that is positionable in close proximity with the propeller assembly of the motor. As the propeller assembly rotates, weeds and other types of underwater vegetation are swept into the blade and cut. The cuttings, in turn, are then thrown by the propeller away from the motor so they cannot foul or otherwise damage the motor parts.

BRIEF DESCRIPTION OF THE DRAWINGS

For a better understanding of these and other objects of the present invention, reference is had to the following detailed description of the invention which is to be read in conjunction with associated drawings wherein.

DESCRIPTION OF THE INVENTION

Figure 1:
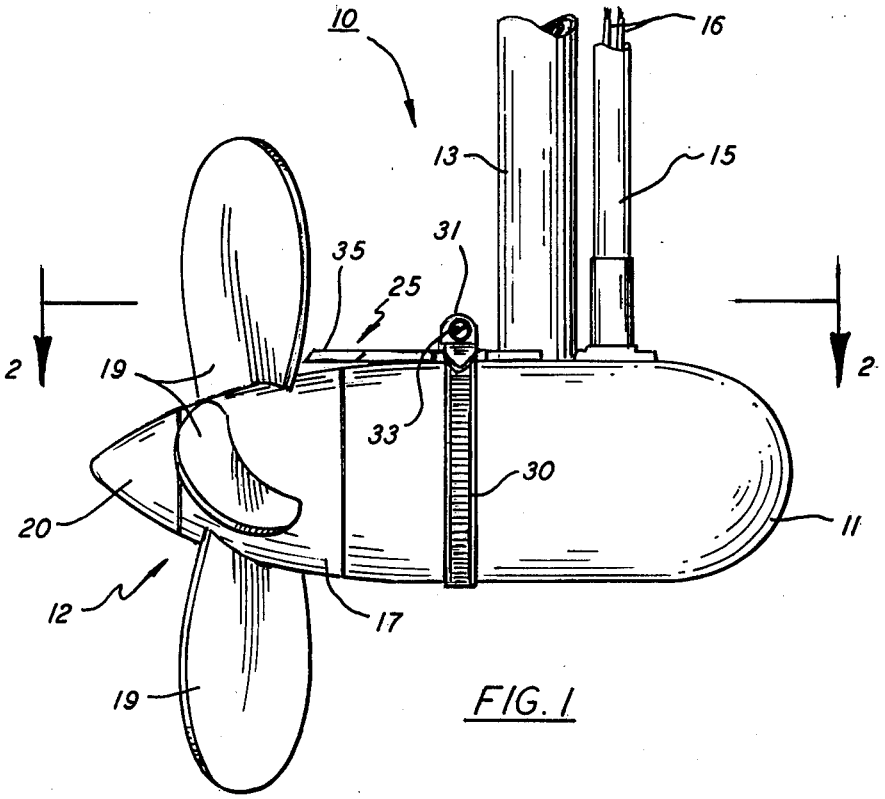
FIG. 1 is a partial side elevation of a small electrical motor using the weed cutting apparatus of the present invention.
Figure 2:
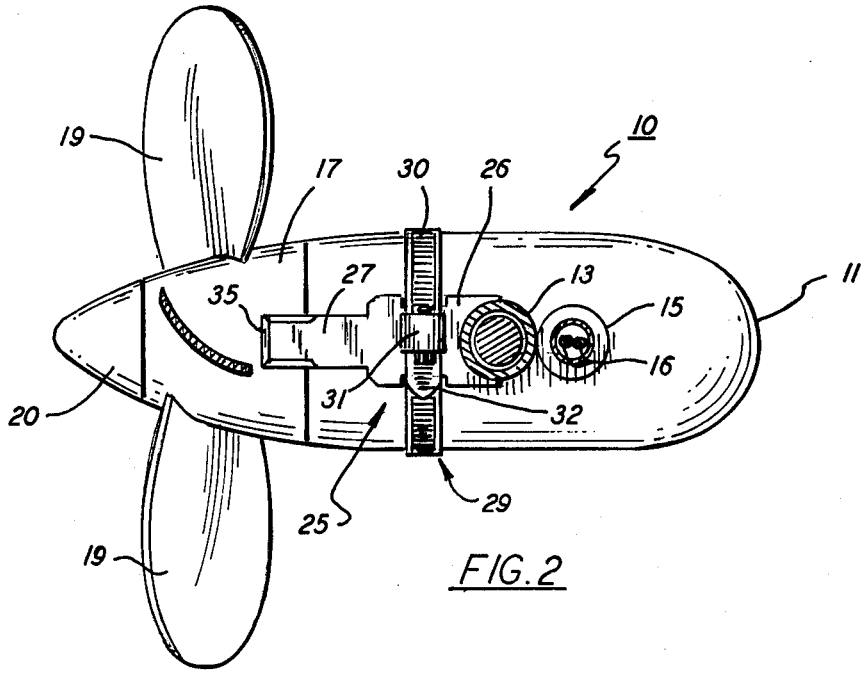
FIG. 2 is a section view taken along lines 2—2 in FIG. 1.

Referring initially to FIGS. 1 and 2 there is illustrated the lower portion of an outboard motor 10 of the type typically used by many fishermen when trolling in relatively shallow waters. The motor is an electrical unit driven by a battery (not shown) stored within the boat. The rotor and stator of the motor are contained in a watertight housing 11. The rotor is adapted to drive a propeller assembly 12 rotatably supported at the rear of the motor housing. The housing is suspended beneath the boat by means of a combination steering and support column 13 that can be manually operated by the fisherman to position the housing and thus maneuver the boat through the water. In the present embodiment of the invention a separate electrical supply line 15 is employed to bring leads 16—16 from the battery power supply to the electrical windings of the motor. It should be clear to one skilled in the art, however, that the electrical leads can be passed through the main support column without departing from the teachings of the present invention.

The propeller assembly 12 includes a rotatable hub 17, that is connected to the rotor of the electrical motor via a drive shaft, and a plurality of propeller wings 19—19 equally spaced about the hub. The wings are contoured to push the boat through the water when the hub rotates in a first direction and to pull the boat when rotated in the opposite direction. A shroud 20 is placed over the back of the hub to protect the mechanism for joining the hub to the rotor and to also streamline the housing.

A flat elongated cutting tool, generally referenced 25, is securely affixed to the top surface of the motor housing. The cutting tool includes a support shank 26 and a cutting blade 27. The end face of the shank is provided with a semi-circular cut out that compliments the outer surface of the support column against which it is abutted in assembly. A clamping means 29 is secured to the shank position of the tool that has a clamping ring 30 that is capable of being passed about the body of the motor housing. The ring contains equally-spaced lateral extended serations formed therein which in effect act as teeth running along the length of the ring. The clamping means further includes a worm mechanism housing 31 for operatively receiving the free end 32 of the ring therein. Although not shown, a worm wheel is rotatably mounted within the mechanism housing that is arranged to operatively engage the ring teeth in driving contact therewith. By turning screw head 33 the ring is drawn through the worm wheel mechanism to securely tighten the ring about the motor housing 11. This, in turn, locks the tool against the support column thereby preventing it from moving when placed under load.

The blade in assembly, extends rearwardly toward the propeller wings with the cutting section thereon overlying the rotating hub 17. A restricted space 34 is provided between the lower surface of the blade and the hub defining a cutting zone. A distal end or blade of the tool contains a knife edge cutting surface 35 that encompasses the end face of the blade that is positioned adjacent to the propeller wings along with a portion of the two opposed side faces of the blade. The knife edges on each side face are brought back a sufficient distance so that the cutting edges completely overlie the hub surface. The front edge of the blade is located in relatively close proximity adjacent to the plane of rotation of the propeller wings to furnish a slight clearance 37 therebetween which defines a second cutting zone.

Heretofore when a boater found his motor entangled in underwater vegetation, he would invariably have to devote a good deal of his time attempting to keep the propelled free of foliage. With the apparatus of the present invention, the motor is able to move freely through underwater foliage without becoming entangled or otherwise snared therein. As should now be evident, the moving propeller serves to sweep the foliage into the knife edge of the stationary blade. Upon contacting the blade, the foliage is passed through the keen cutting edge causing it to be severed. The cuttings, acting under the influence of the spinning propeller, are thrown away from the motor, thus preventing them from being drawn into its working components. Accordingly, weeds and other underwater vegetation that might be encountered by a motor equipped with the present cutting blade are rapidly and efficiently cut and removed from the motor region thereby enabling the motor to run freely and easily through regions of dense growth.

The present cutting tool arrangement has been used in conjunction with a number of relatively low horsepower motors of the type typically used by fishermen when trolling. The motors so equipped have shown little if any loss of power when operating in areas containing dense or heavy underwater foliage. The present invention is not necessarily limited to use in association with smaller electrical motors but can also be used with equal success with larger motors of the outboard and the inboard-outboard class.

Figure 3:
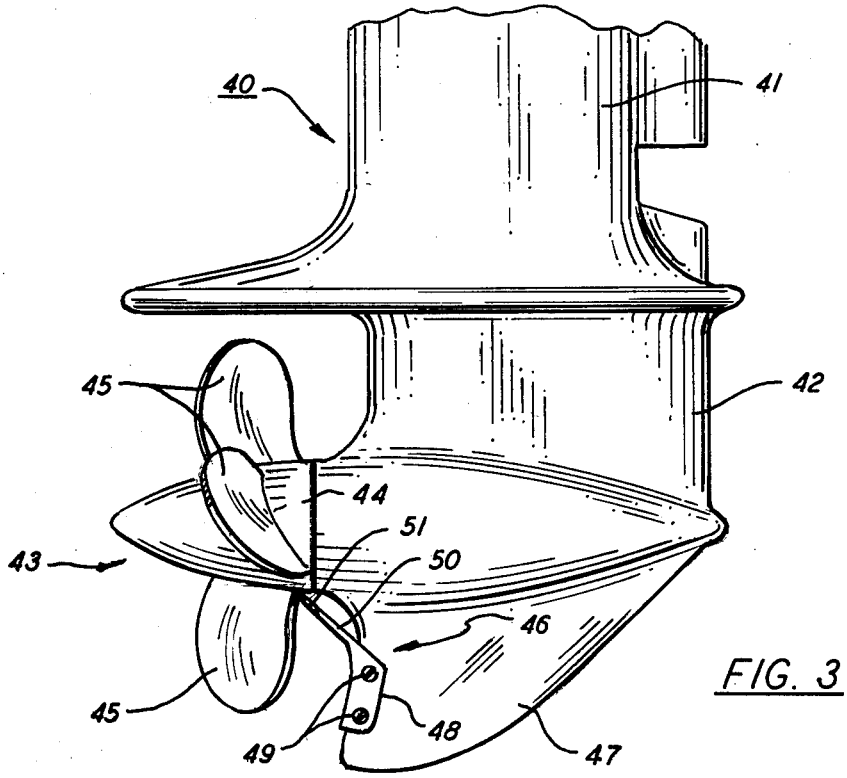
FIG. 3 is another partial side elevation showing the lower section of a relatively large outboard motor that utilizes the teachings of the present invention.

With further reference to FIG. 3, there is shown the lower portion of a relatively large boat motor 40 that includes a casing 41, a lower drive housing 42 and a propeller assembly 43. Again, the propeller assembly consists of a rotatable hub 44 having a plurality of radially extended propeller wings 45 secured thereto. A cutting tool 46 is secured to the lower drive housing and is arranged to coact with the propeller to cut foliage in the same manner as described above. The present blade has a bifurcated shank 48 that is adapted to slip over the fin 47 of the lower drive housing and which is secured in place by means of a pair of screws 49—49 threaded into the housing. The blade section 50 of the cutting tool is supported beneath the propeller assembly as shown with the cutting edges 51 thereon being positioned in close proximity with both the hub and the propeller wings to provide the heretofore noted cutting acting.

Figure 4:
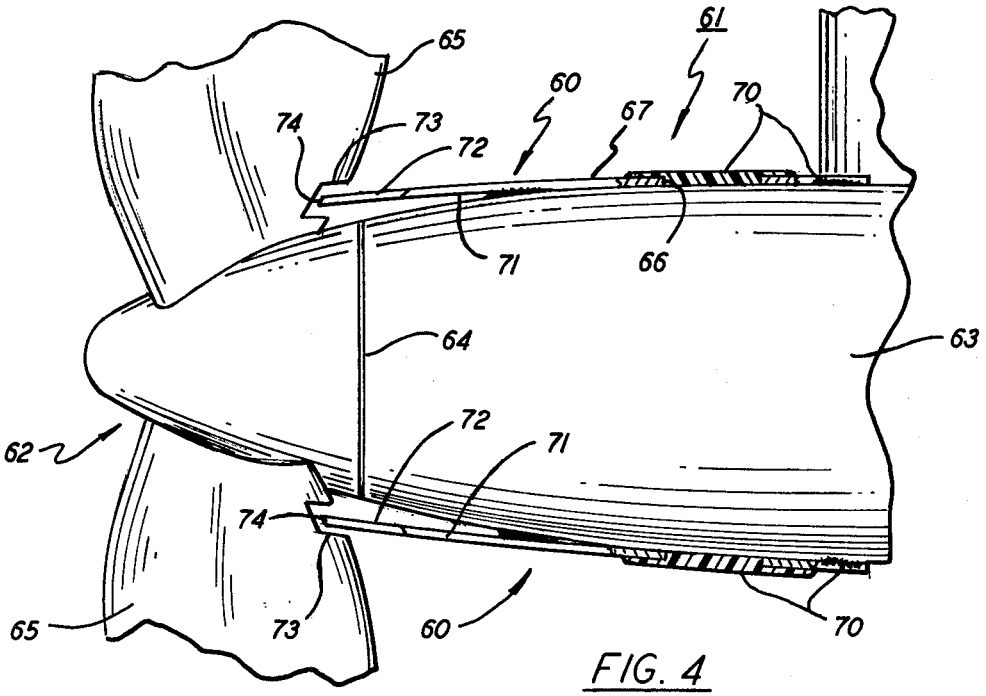
FIG. 4 is still another partial side elevation of a boat motor using two opposed weed cutting tools which embody the teachings of the present invention.

Turning now to FIG. 4, there is shown another embodiment of the present invention in which a plurality of cutting tools 60—60 are used in conjunction with a motor 61. Here again, a propeller assembly 62 is rotatably mounted upon the motor housing 63 with the propeller assembly including a hub 64 and a series of propeller wings 65—65. Elongated slotted holes 66—66 are formed in the shank 67 of each blade. Each blade is secured to the housing by means of a commercially available epoxy resin 70 that has been specifically developed for joining metal to metal. In practice, the slotted holes are completely filled with resin as shown to provide added bonding strength to the system.

The blade section 71 of each cutting tool 60 is brought into close proximity with the hub of the propeller assembly with the sides of the knife edge 72 overlying the hub surface. It should be noted, however, that in this embodiment each wing of the propeller contains a notch 73 formed in the back face thereof into which the front face 74 of each blade passes. As can be seen in this application of the invention, the wings and the cutting edges of the blades are capable of coacting in a more positive manner to provide for an extremely efficient cutting action. Although two separate cutting tools are shown in FIG. 4, it should be evident that any number of cutting tools may be similarly employed without departing from the teachings of the present invention.

While this invention has been described with reference to the details as set forth above, it is not limited to the specific structure as disclosed and the invention is intended to cover any modifications or changes as may come within the scope of the following claims.

We claim:

1. In a boat motor having a housing and a propeller that includes a hub rotatably mounted in the housing and a plurality of propeller wings radially extending from the hub, apparatus for slicing through underwater foliage as it approaches the propeller wings that includes an elongated cutting tool having a shank and a dependent cutting blade axially aligned along the length of the tool, said blade being a flat, thin element having at least a pair of cutting surfaces formed along the opposed side edges thereof, and mounting means affixed to the shank of the tool for attaching the tool to the motor housing adjacent to the propeller assembly to position the blade over the propeller hub in close proximity therewith with the axis of the blade lying in the same plane as the rotational axis of the propeller and the plane of the flat, thin blade being substantially tangent to the direction of rotation of said propeller.

2. The apparatus of claim 1 wherein the length of the cutting edges formed along the side edges of the blade is of greater length than the axial extension of the blade over the hub.

3. The apparatus of claim 1 wherein said blade includes a distal edge that is positioned in close proximity with the radially extended propeller wings, said distal edge further includes a cutting edge formed thereon.

4. The apparatus of claim 1 wherein said mounting means includes a removable collar that is passed around the motor housing adjacent to the hub for clamping the tool to the housing.

* * * * *